US010709998B2

(12) United States Patent
Kislevitz et al.

(10) Patent No.: US 10,709,998 B2
(45) **Date of Patent: *Jul. 14, 2020**

(54) CARD-LIKE STRUCTURE AND CONNECTOR TOYS FOR BUILDING

(71) Applicant: The Upper Deck Company, Carlsbad, CA (US)

(72) Inventors: Adam Kislevitz, Englewood, NJ (US); Mary Sholl, West Palm Beach, FL (US)

(73) Assignee: The Upper Deck Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/892,046

(22) Filed: Feb. 8, 2018

(65) Prior Publication Data

US 2018/0161689 A1 Jun. 14, 2018

Related U.S. Application Data

(63) Continuation of application No. 14/487,054, filed on Sep. 15, 2014, now Pat. No. 9,919,235.

(51) Int. Cl.
*A63H 33/08* (2006.01)
*A63H 33/10* (2006.01)

(52) U.S. Cl.
CPC ..... *A63H 33/08* (2013.01); *A63H 33/10* (2013.01); *A63H 33/105* (2013.01)

(58) Field of Classification Search
CPC ..... A63H 33/08; A63H 33/086; A63H 33/10; A63H 33/105; A63H 33/108
USPC ..... 446/105, 108, 111, 112, 113, 114, 115, 446/117, 124
See application file for complete search history.

(56) References Cited

U.S. PATENT DOCUMENTS

| | | | |
|---|---|---|---|
| 298,633 | A | 5/1884 | Snow |
| 1,242,272 | A | 10/1917 | Thurman |
| 1,281,856 | A | 10/1918 | Shaw |
| 1,883,214 | A | 10/1932 | Wilson et al. |
| 1,898,297 | A | 2/1933 | Fox |
| 2,131,349 | A | 9/1938 | Kreider, Jr. |
| 2,204,319 | A | 6/1940 | Parsons et al. |
| 2,883,764 | A | 4/1959 | Stephens |

(Continued)

FOREIGN PATENT DOCUMENTS

| | | |
|---|---|---|
| DE | 2707056 A1 | 8/1977 |
| EP | 0761272 A2 | 8/1997 |

(Continued)

OTHER PUBLICATIONS

The International Search Report and Written Opinion of the International Searching Authority for PCT/US2015/050032, Upper Deck Company, dated Dec. 23, 2015 (related application).

*Primary Examiner* — Joseph B Baldori
(74) *Attorney, Agent, or Firm* — Roeder & Broder LLP; Steven G. Roeder

(57) ABSTRACT

Provided herein is a set of card-like structure and connector toys for building; the set comprising one or more card-like structures and one or more end cap connectors, wherein the one or more end cap connectors comprise one or more slots for inserting the card-like structures. Also provided herein is a connector toy or a kit of connector toys; comprising one or more slots for inserting card-like structures for building.

22 Claims, 6 Drawing Sheets

(56) References Cited

U.S. PATENT DOCUMENTS

| | | | |
|---|---|---|---|
| 3,119,154 | A | 1/1964 | Moore |
| 3,137,967 | A | 6/1964 | Flieth |
| 3,657,838 | A | 4/1972 | Hanning et al. |
| 3,747,262 | A | 7/1973 | Endres |
| 3,827,177 | A | 8/1974 | Wengel |
| 3,902,291 | A | 9/1975 | Zucht |
| 4,148,152 | A | 4/1979 | Barlow et al. |
| 4,193,221 | A | 3/1980 | Beck |
| 4,270,302 | A | 6/1981 | Dandia |
| 4,334,868 | A | 6/1982 | Levinrad |
| 5,015,149 | A | 5/1991 | Weiss |
| 5,036,634 | A | 8/1991 | Lessard et al. |
| 5,215,490 | A | 6/1993 | Szoradi |
| 5,277,512 | A | 1/1994 | Dwillies |
| 5,487,690 | A | 1/1996 | Stoffle et al. |
| 5,647,181 | A | 7/1997 | Hunts |
| 5,681,201 | A | 10/1997 | Choi |
| 5,895,045 | A | 4/1999 | Vilar |
| 5,961,364 | A | 10/1999 | Bach et al. |
| 6,004,182 | A | 12/1999 | Pasin |
| 6,015,149 | A | 1/2000 | Burk |
| 6,149,485 | A | 11/2000 | Christiansen |
| 6,443,798 | B1 | 9/2002 | Perry |
| 6,558,222 | B1 | 5/2003 | Maddock |
| 6,718,709 | B2 | 4/2004 | Koutras et al. |
| 6,761,609 | B1 | 7/2004 | Andersen |
| 6,997,771 | B1 | 2/2006 | Lucier |
| 8,296,981 | B1 * | 10/2012 | Gardinier ..... G09F 7/10 40/312 |
| 9,919,235 | B2 * | 3/2018 | Kislevitz ..... A63H 33/08 |
| 2002/0090881 | A1 | 7/2002 | Turnham |
| 2003/0162374 | A1 | 8/2003 | Brown et al. |
| 2007/0252332 | A1 | 11/2007 | Cassidy |

FOREIGN PATENT DOCUMENTS

| | | | |
|---|---|---|---|
| KR | 201200825171 | A | 7/2012 |
| WO | WO1997018875 | A1 | 5/1997 |
| WO | WO2016044181 | A1 | 3/2016 |

* cited by examiner

CARD-LIKE STRUCTURE AND CONNECTOR TOYS FOR BUILDING

RELATED APPLICATION

This application is a continuation application of U.S. application Ser. No. 14/487,054 filed on Sep. 15, 2014 and entitled "CARD-LIKE STRUCTURE AND CONNECTOR TOYS FOR BUILDING". As far as permitted, the contents of U.S. application Ser. No. 14/487,054 is incorporated herein by reference.

FIELD OF INVENTION

The present invention relates to the field of card-like toy blocks, bricks, structures and/or connectors for building.

BACKGROUND OF DISCLOSURE

It is a popular activity for individuals, particularly children, to use toy elements and/or structures for constructing and/or erecting houses and/or buildings and/or villages and/or any desired object. There are, therefore, a wide variety of toy building sets readily available ranging from simple stacking elements to complex connecting and/or interlocking parts. Such sets often comprise a plurality of pieces with connection means used to form toy buildings and/or other miniature structures.

Certain of these types of building sets employ card-like structures, including but not limited to cards and connector pieces, or flat structures with surface protrusions or holes or sheet elements with corresponding grooved coupling studs.

While toy building sets having cards or card-like or flat structures or sheet or panel elements and corresponding connector parts are readily available and may be found, for example in U.S. Pat. Nos. 6,761,609 B1; 2,883,764 A; 3,119,154 A; 2,204,319 A; 298,633 A; 2,131,349 A; 3,747,262 A; 5,215,490 A; 5,895,045 A; 5,015,149 A; 6,997,771 B1; 6,149,485 A; 6,443,798 B1; United States Application Numbers 2002/0090881 A1; 2003/0162374 A1; and 2007/0252332 A1; European Application Number 0761272 A2; and International Application Number WO1997018875 A1; none of these references disclose the embodiments of the card-like structures and connectors disclosed herein.

Therefore, a toy building set with card-like structures for slotting into corresponding connector pieces provides a simple yet unique and entertaining option for fulfilling an individual's desire to construct buildings and/or objects. Additionally, the toy building set disclosed herein may be advantageously used in conjunction with existing Lego® or other similar building bricks.

All documents and references cited herein and in the referenced patent documents, are hereby incorporated herein by reference.

SUMMARY OF THE INVENTION

The present inventors have designed a toy building set with card-like structures for fitting and/or slotting into corresponding connector pieces providing a simple yet unique and entertaining option for fulfilling an individual's desire to construct miniature buildings and/or objects.

Disclosed herein is a set of card-like structure and connector toys for building; the set comprising: one or more card-like structures and one or more end cap connectors, wherein the one or more end cap connectors comprise one or more slots for inserting the card-like structures.

In another embodiment, the one or more slots are on the one or more end cap connectors in a configuration selected from the group consisting of bottom, top, side, sides, and a combination thereof.

In another embodiment, the one or more card-like structures are flat.

In another embodiment, the one or more end cap connectors comprise a connection pattern.

Also disclosed herein is a connector toy for building with card-like structures; wherein the connector toy is an end cap connector comprising one or more slots for inserting card-like structures.

In another embodiment, the one or more slots on the end cap connectors are in a configuration selected from the group consisting of bottom, top, side, sides, and a combination thereof.

In another embodiment, the end cap connector comprises a connection pattern.

Also disclosed herein is a kit of connector toys for building with card-like structures; the kit comprising one or more end cap connectors comprising one or more slots for inserting card-like structures.

In another embodiment, the one or more slots on the one or more end cap connectors are in a configuration selected from the group consisting of bottom, top, side, sides, and a combination thereof.

In another embodiment, the one or more end cap connectors comprise a connection pattern.

In another embodiment, the kit comprises card-like structures.

In other embodiments, the set of card-like structure and connector toys in the preceding paragraphs may additionally comprise Lego® building bricks and/or other similar building bricks.

In other embodiments, the set of card-like structure and connector toys in the preceding paragraphs may additionally comprise one or more character figures, one or more designs and/or graphics, and/or one or more character figures corresponding to a design or graphic on the one or more card-like structures and/or end cap connectors.

In other embodiment, the set of card-like structure and connector toys in the preceding paragraphs may incorporate any of the preceding or subsequently disclosed embodiments.

In other embodiments, the connector toy or connector toys in the preceding paragraphs may additionally incorporate any of the preceding or subsequently disclosed embodiments.

The Summary of the Invention is not intended to define the claims nor is it intended to limit the scope of the invention in any manner.

Other features and advantages of the invention will be apparent from the following Drawings, Detailed Description, and the Claims.

DETAILED DESCRIPTION

Figure 1A:
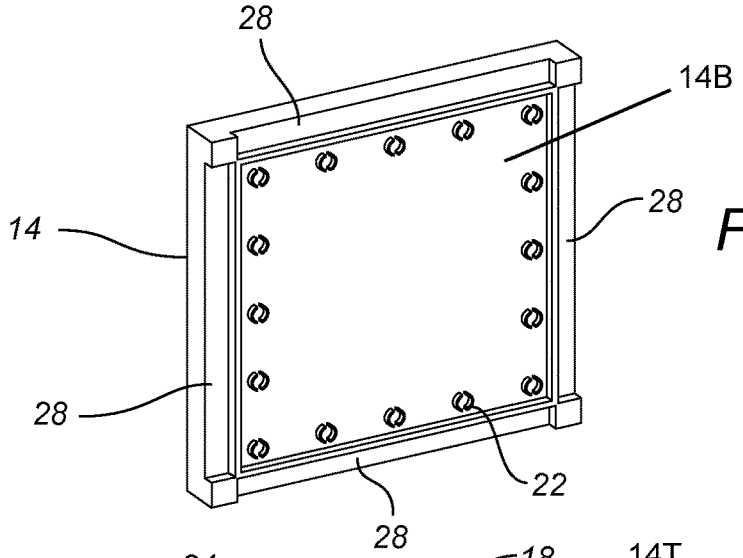
FIG. 1A-1D illustrates perspective top and bottom views of embodiments of the end cap connectors disclosed herein.

The present invention is illustrated in the drawings and description in which like elements are assigned the same reference numerals. However, while particular embodiments are illustrated in the drawings, there is no intention to limit the present invention to the specific embodiment or embodiments disclosed. Rather, the present invention is intended to cover all modifications, alternative constructions, and equivalents falling within the spirit and scope of the invention. As such, the drawings are intended to be illustrative and not restrictive.

Unless otherwise defined, all technical terms used herein have the same meaning as commonly understood by one of ordinary skill in the art to which this technology belongs.

Exemplary embodiments of the present invention are depicted in FIG. 1-4.

The card-like structures and end cap connectors disclosed herein provide a unique yet simple means for building miniature objects in both horizontal and vertical configurations. As utilized herein, the card-like structures and the end cap connectors can be referred to individually and/or collectively as a "connector toy assembly", a "connector toy" or a "toy assembly". Additionally, the various components of the "connector toy assembly", "connector toy" or "toy assembly" can also be referred to generally as a "kit of connector toys" or a "kit of parts".

For the purposes of the present invention, the terminology "corresponds to" means that there is a functional and/or mechanical relationship between objects which correspond to each other. For example, the card-like structures and end cap connectors disclosed herein correspond to each other or mechanically connect with each other when the card-like structure is inserted into the slot or elongated groove on the end cap connector designed to accommodate an end or edge of the card-like structure.

For the purposes of the present invention, the terminology "card-like" means a geometrically shaped sheet or panel such as, without limitation, in the shape of a square or rectangle. The terminology "card-like structure" may be used interchangeably with the terms "card" or "plate" or "plate-like structure" or "sheet" or "sheet-like" or "panel". In certain embodiments, card-like structures will have a flat surface or surfaces or face or faces and will be in a corresponding thickness to fit into a slot or elongated groove of an end cap connector designed for receiving the card-like structure. In an embodiment of the card-like structures disclosed herein, the card-like structures are made of 20 point card stock. As is well established knowledge in the art of paper products, a point is equal to 0.001 inches and is used to indicate a thickness of the paper. In general, the higher the point, the thicker and therefore firmer the paper product.

For the purposes of the present invention, the term "slot" may be interchangeable with the terms "slit" or "groove". In certain embodiments, the card slot is an elongated groove which corresponds to an end or edge of the card-like structure. In one embodiment of the invention disclosed herein, a card-like structure such as a 20 point card stock or the like fits snuggly into a corresponding card slot.

Figure 1B:
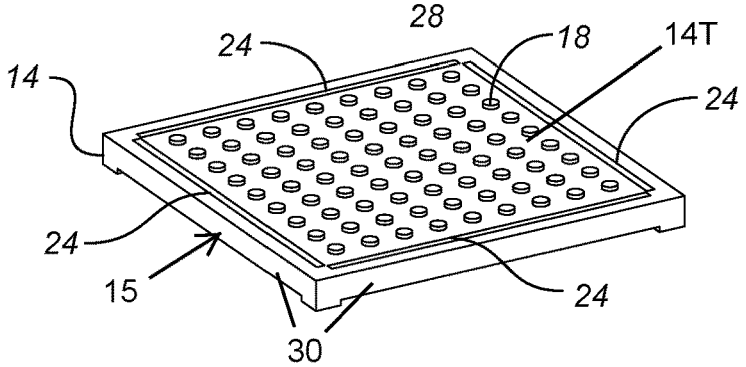

FIGS. 1A-1B show perspective top and bottom views of an embodiment of an 14 end cap connector disclosed herein having 24 slots on the 14T top side (or upper side) only. In this embodiment, the 14 end cap connector additionally has a 18 concentric (protruding) connection pattern on the 14T top side (upper side) of the 14 end cap connector. In other embodiments, such a concentric connection pattern is a Lego® connection pattern. The corresponding (receiving) 22 connection pattern is on the 14B bottom side of the 14 end cap connector. The 24 slots run parallel to 30 edges of the 14 end cap connector that define a 15 perimeter of the 14 end cap connector and correspond in dimension and/or length to the 10 card-like structures which can be fitted into and/or inserted therein to provide a mechanical connection between the 14 connector and the 10 card-like structure. Upon connective assembly, i.e. a direct coupling, of the 14 end cap connector with another end cap connector (14 or 12 below) a 28 side slot is created. Stated in another manner, each of the 12, 14 end cap connectors include a portion of the 28 side slot. Such a 28 side slot accommodates the 10 card-like structure disclosed herein.

Figure 1C:
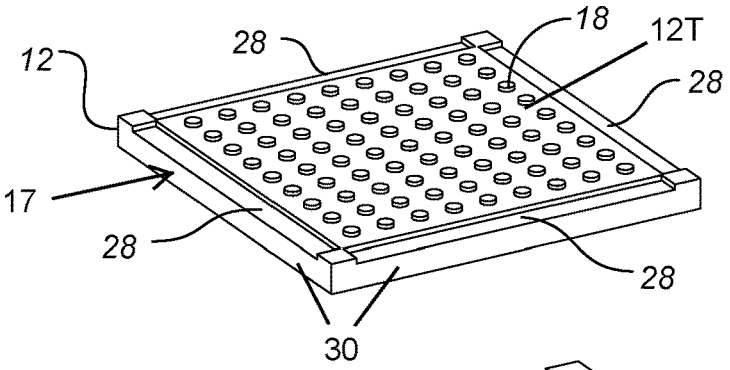
Figure 1D:
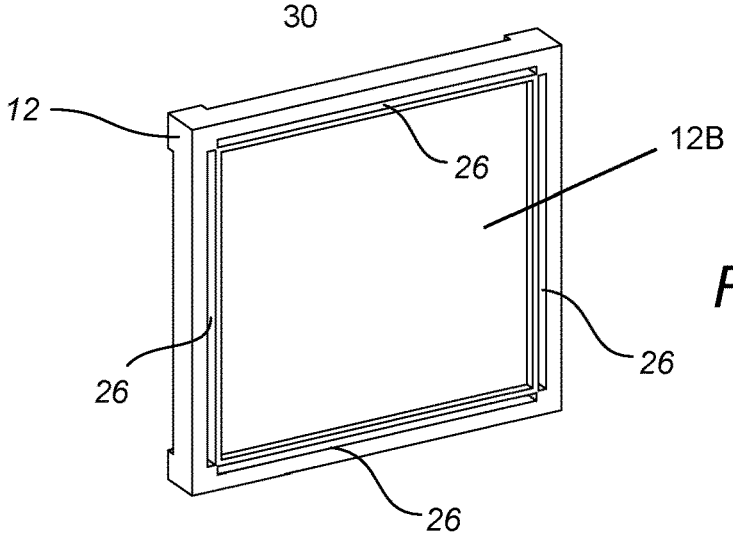

FIGS. 1C-1D show perspective top and bottom views of an embodiment of an 12 end cap connector of the present invention having 26 slots on the 12B bottom side (or underside) only. In this embodiment, the 12 end cap connector has a 18 concentric connection pattern (or nodes) on the 12T top side (upper side) of the 12 end cap connector. The corresponding 22 connection pattern is on the 14B bottom side (underside) of a 14 end cap connector disclosed herein. The 26 slots run parallel to the 30 edges of the 12 end cap connector that define a 17 perimeter of the 12 end cap connector and correspond in dimension and/or length to the dimension and/or length of the 10 card-like structures which can be fitted into and/or inserted therein to provide a mechanical connection between the 12 connector and the 10 card-like structure. Upon connective assembly, i.e. a direct coupling, of the 12 end cap connector with an 14 end cap connector a 28 side slot is created. Such a 28 side slot accommodates the 10 card-like structure disclosed herein.

Figure 2B:
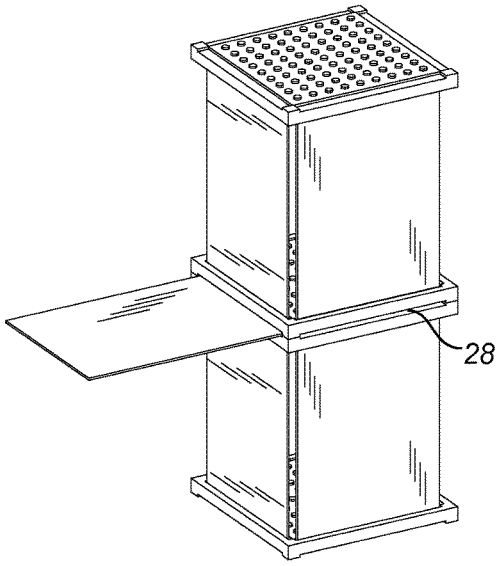
FIG. 2A-2B illustrates perspective views of exemplary assembly of an embodiment of the end cap connectors and the card-like structures disclosed herein.
Figure 2A:
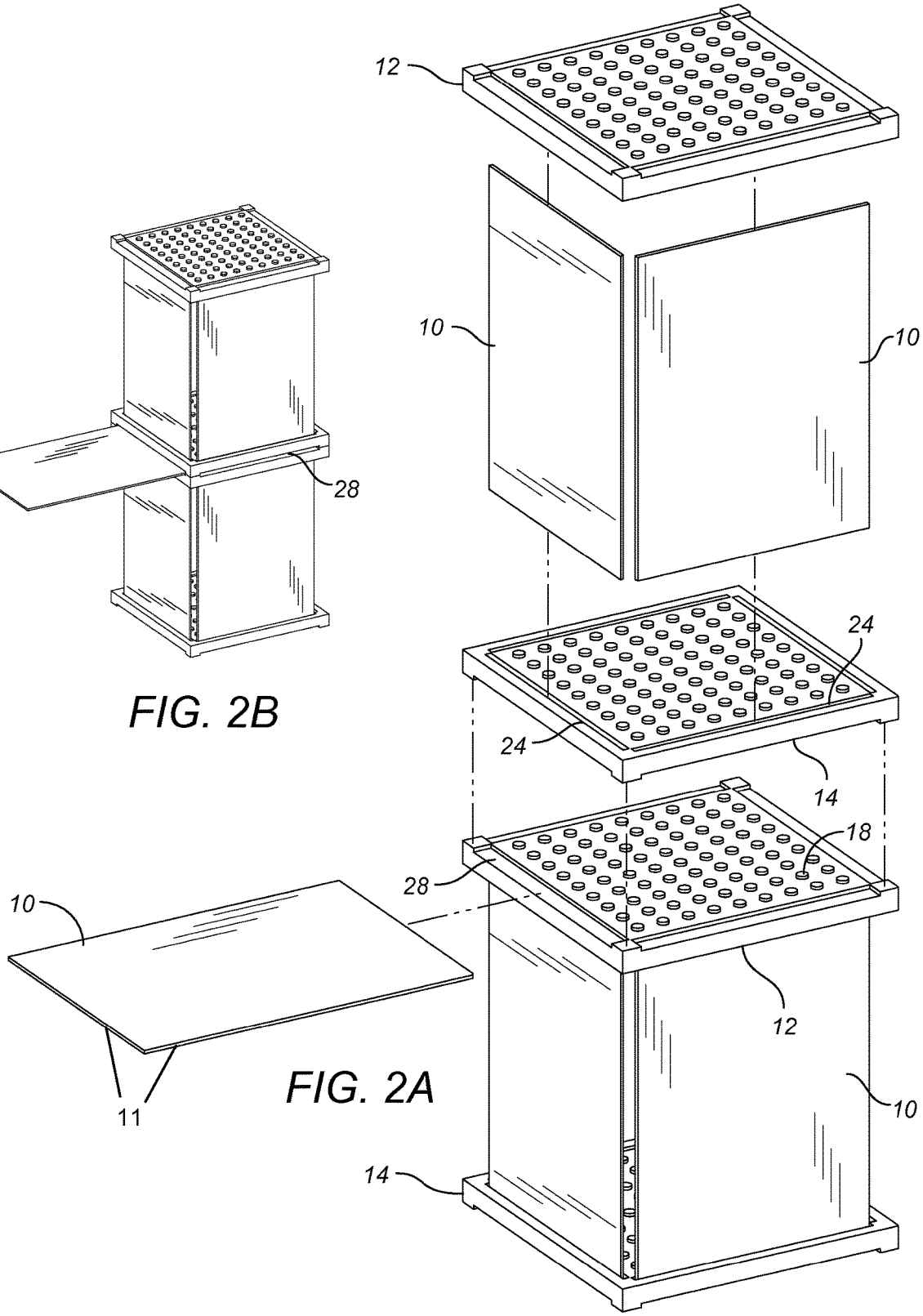

FIG. 2A shows perspective views of exemplary assembly of both 12 and 14 end cap connectors with the 10 card-like structures disclosed herein. FIG. 2B shows a 28 side slot created by the connection between the 12 and 14 end cap connectors. Such a 28 side slot accommodates the card-like structure disclosed herein. Additionally, as illustrated, each of the 10 card-like structures includes a 11 plurality of card edges. For any given 10 card-like structure, one of the 11 card edges can be positioned within one of the 24 slots of the 14 end cap connector and an opposed 11 card edge can be positioned within one of the 26 slots of the 12 end cap connector. For example, as shown, an entirety of one of the 11 card edges can be positioned within one of the 24 slots of the 14 end cap connector, and an entirety of an opposed 11 card edge can be positioned within one of the 26 slots of the 12 end cap connector. Further, a 11 card edge of one of the 10 card-like structures can also be positioned with the 28 side slot formed when the 14 end cap connector is directly coupled to the 12 end cap connector.

Figure 3A:
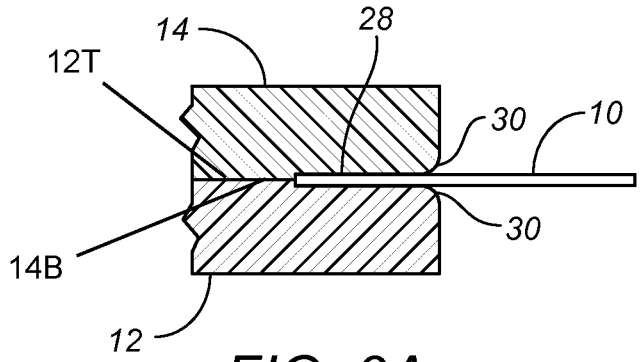
FIG. 3A-3D illustrates side perspective views of an embodiment of the end cap connectors and card-like structures disclosed herein.
Figure 3B:
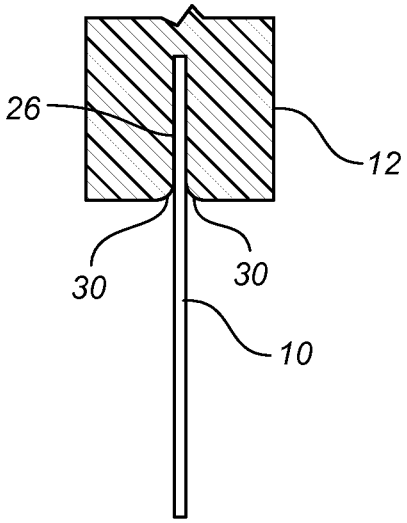
Figure 3C:
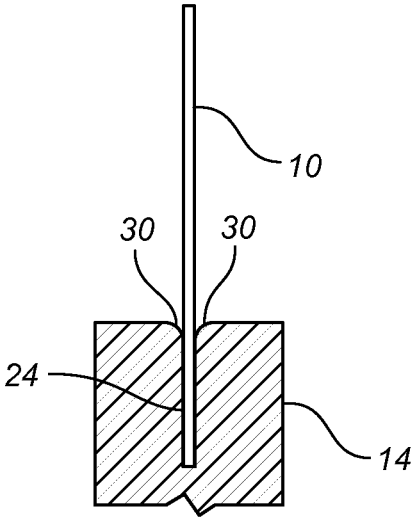
Figure 3D:
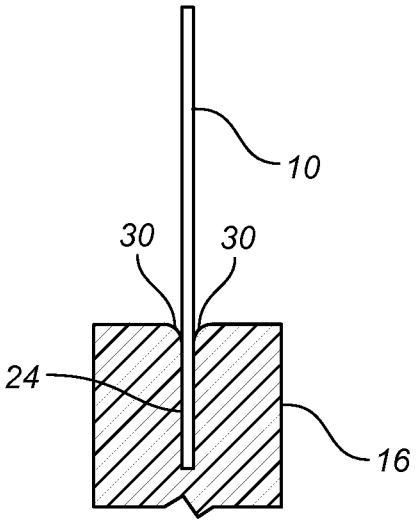

FIG. 3A shows a perspective side view of 12 and 14 end cap connectors combined in such a manner where the 12T top side of 12 end cap connector connects with the 14B bottom side of 14 end cap connector. In this embodiment, the combined configuration of 12 and 14, each having 30 radiused (or rounded) edges, creates a 28 card slot corresponding in dimension and/or length to the dimension and/or length of the 10 card-like structures disclosed herein. FIGS. 3B-3C show perspective side views of 12 and 14 and 16 (shown below) end cap connectors combined in such a manner where the top side connects with the corresponding bottom side of the 12 and 14 and 16 end cap connectors. In these embodiments, the combined configuration, having 30 radiused edges creates 24, 26, and/or 28 card slots corresponding in dimension and/or length to the dimension and/or length of the 10 card-like structures disclosed herein.

Figure 4A:
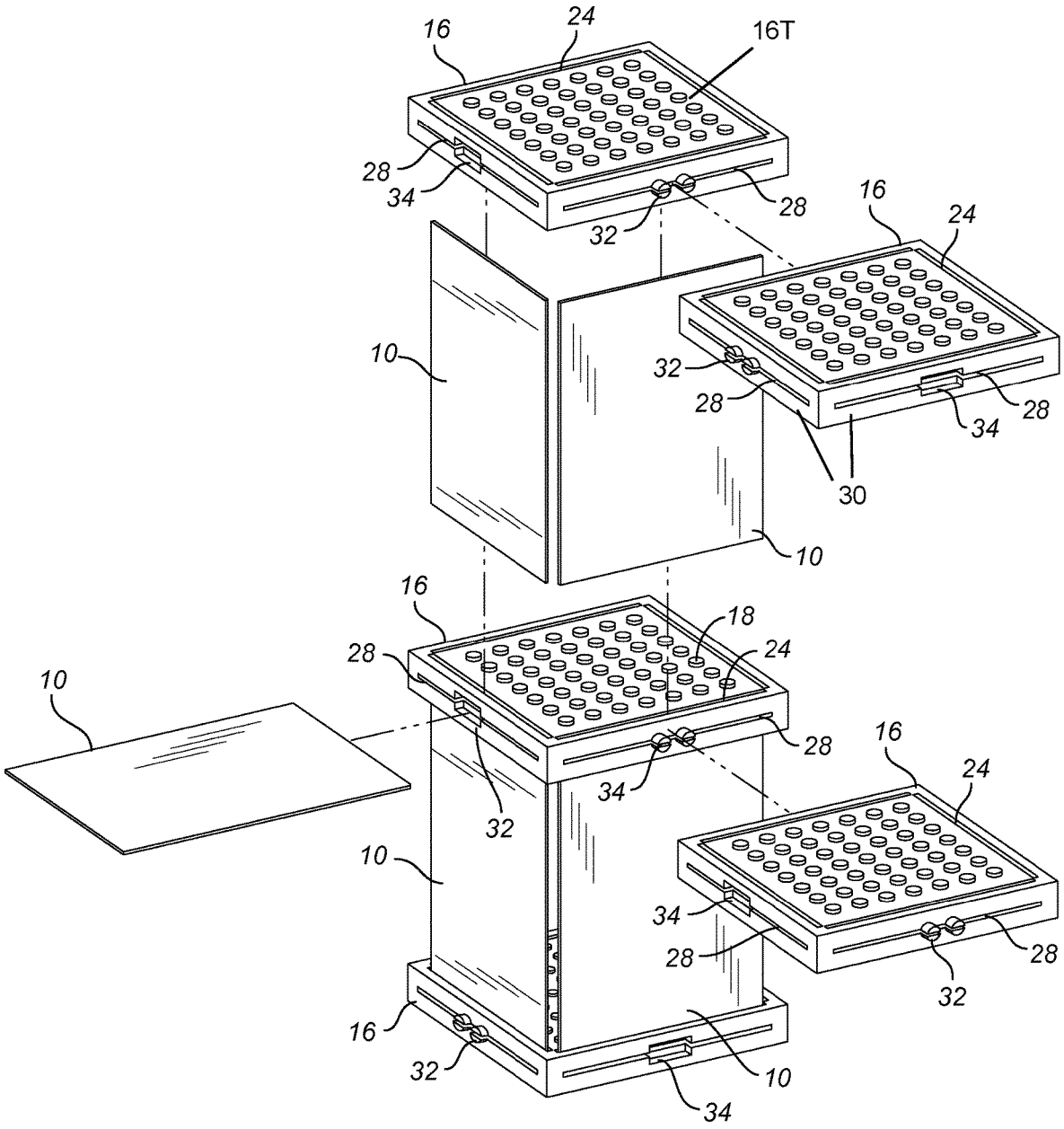
FIG. 4A-4C illustrates perspective views of exemplary assembly of card-like structures and end cap connectors and a perspective view of an underside embodiment of an end cap connector disclosed herein.
Figure 4B:
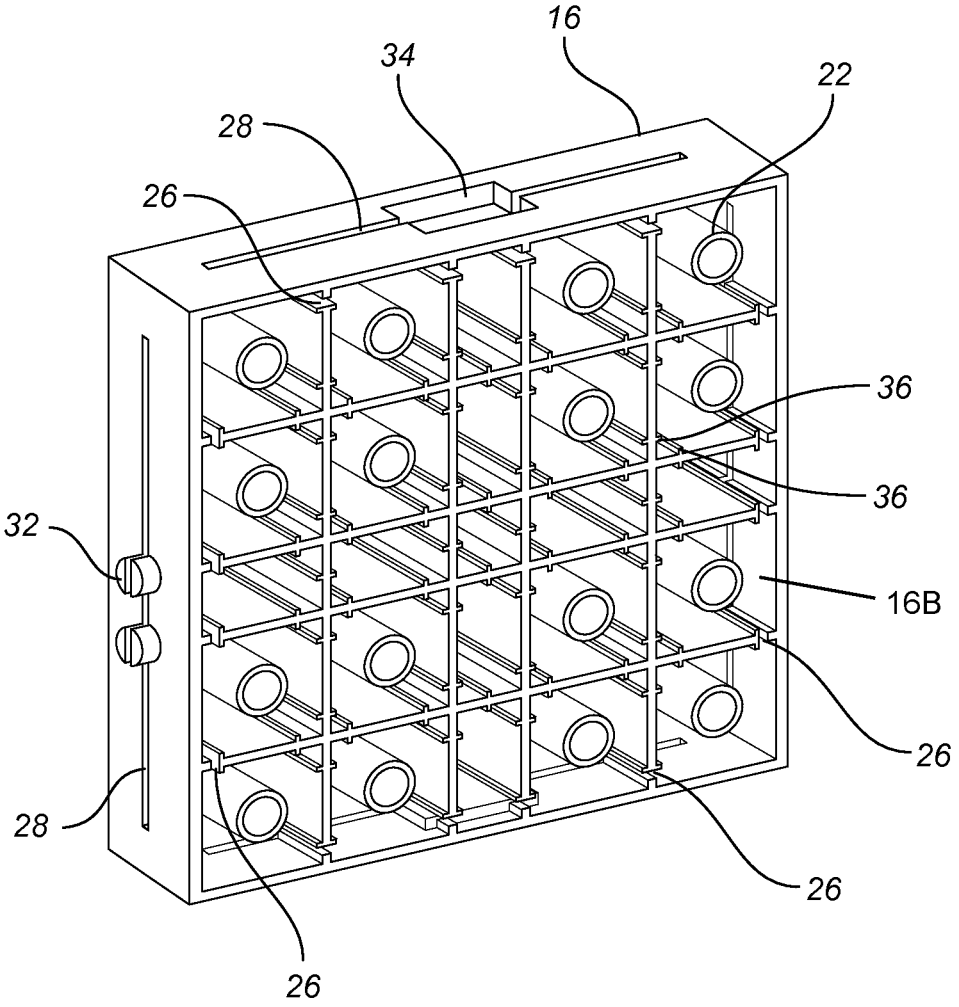
Figure 4C:
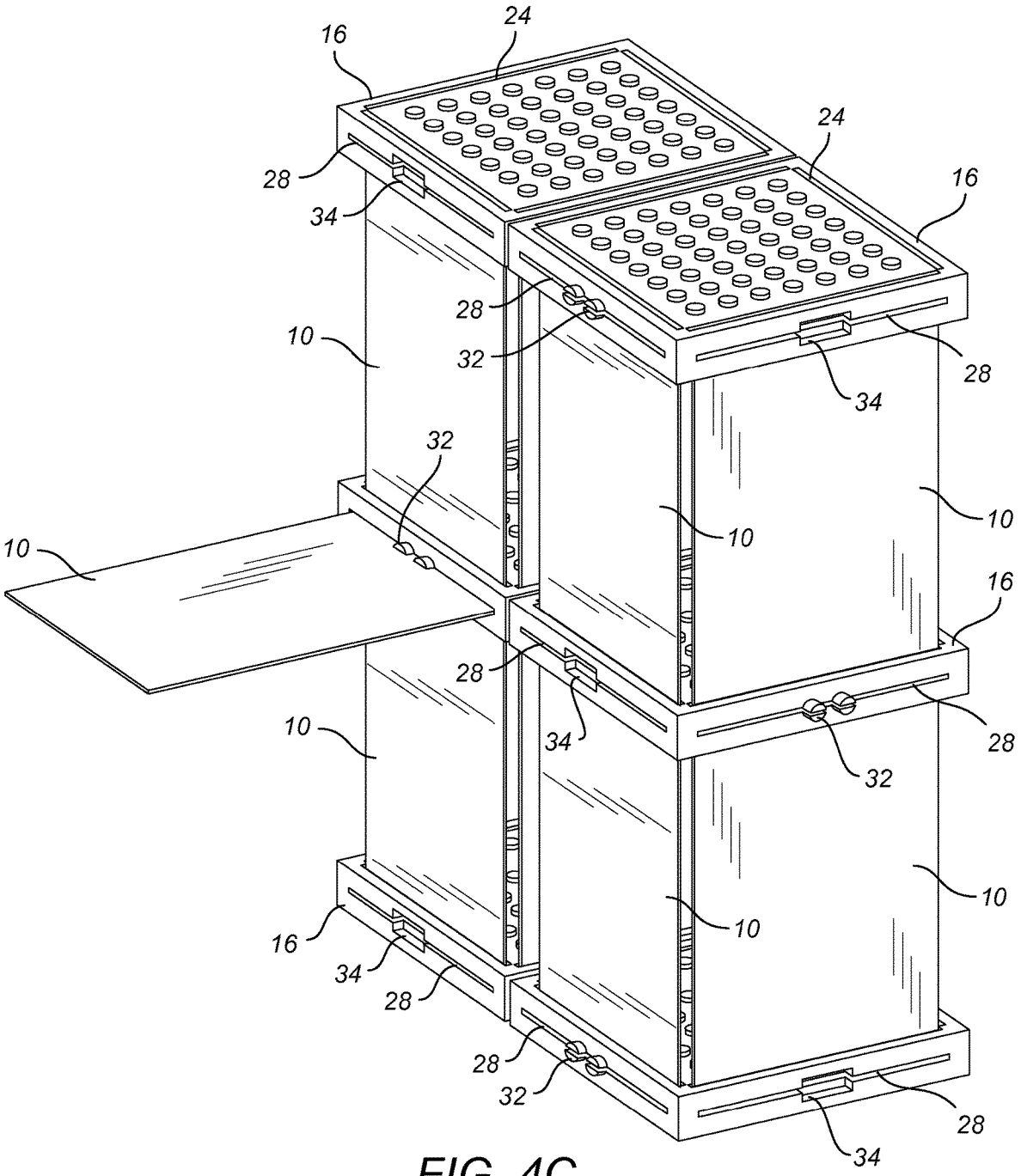

FIGS. 4A-4B show perspective side, top and bottom (underside) views of an embodiment of an 16 end cap connector of the present invention having 24 slots on the 16T top side (upper side) and 26 slots on the 16B bottom side (under side) and additional 28 slots on the sides or 30 edges of the 16 end cap connector. In one embodiment, the one or more sides or 30 edges of the 16 end cap connector comprise female and male connective features or connection patterns such as, without limitation, 32 dual concentric protrusions (or nodes) which fit or snap into a corresponding 34 receiving rectangular space providing for connectivity between 16 end cap connectors. Embodiments of end cap connectors such as the 16 end cap connector shown illustrate a wide variety of construction possibilities in both vertical and horizontal configurations. The 10 card-like structures are slotted into and/or fitted therein the 24, 26, and/or 28 slots or elongated grooves on the 16 end cap connectors to provide a mechanical connection between the parts of the building set. In one embodiment, the 16B underside of the 16 end cap connector comprises a triangular configuration of friction points utilizing an 22 open concentric friction point and 36 miniature bar-type friction points to engage with (receive) 18 a (protruding) concentric connection pattern (or node) on the 16T top side (upper side) of another 16 end cap connector. In one embodiment, there is a 7 by 7 pattern of 18 (protruding) concentric connections or nodes on the 16T top side (upper side) of an 16 end cap connector. In another embodiment, there is a 9 by 9 pattern of 18 (protruding) concentric connections or nodes on the 16T top side (upper side) of an 16 end cap connector. In other embodiments, the 10 card-like structure and connector building sets disclosed herein are compatible with existing Lego® or other connection bricks. Exemplary construction is shown in FIG. 4C.

The 10 card-like structures can be inserted into corresponding 24, 26, and/or 28 slots of the 12 and 14 and/or 16 end cap connectors. The 24, 26, and/or 28 card slots correspond in dimension and/or length to the dimension and/or length of the 10 card-like structure. The 10 card-like structures fit snugly into the corresponding 24, 26, and/or 28 card slots. The frictional force resulting from placement of the 10 card-like structure into a corresponding 24, 26, and/or 28 card slot of an 12 and 14 and/or 16 end cap connector provides stabilized positioning of the building set components for constructing objects.

The 10 card-like structures and/or 12 and 14 and/or 16 end cap connectors may be provided in a variety of shapes and sizes. In one embodiment, the card slots have a depth of about 2.8 millimeters. In another embodiment, 24, 26, and/or 28 card slots are about 2.52 inches wide, the 10 card-like structures are about 2.5 inches wide so that there is about 0.2 inches of clearance to fit a 10 card-like structure into a corresponding 24, 26, and/or 28 card slot. In another embodiment, 12 and 14 and/or 16 end cap connector width (not including the protruding nodes or concentric connection pattern) is about 2.8125 inches. In another embodiment, the 24, 26, and/or 28 card slots on the 12 and 14 and/or 16 end cap connectors have a depth of about 3/16 inches. In another embodiment, 12 and 14 and/or 16 end cap connectors are provided in a square shape and measure about 3 inches by 3 inches. In another embodiment, the width of an 12 and 14 and/or 16 end cap connector is about ¼ of an inch. In another embodiment, the length of a 24, 26, and/or 28 card slot on the 12 and 14 and/or 16 end cap connector is about 2 and 9/16 inches and the distance between one 24, 26, and/or 28 card slot to its opposite 24, 26, and/or 28 card slot on the 12 and 14 and/or 16 end cap connector is about 2 and ½ inches. In another embodiment, the width of an 12 and 14 and/or 16 end cap connector is about ½ of an inch. In another embodiment, the 10 card-like structures are provided in a rectangular or square shape and have ends or edges which correspond to the 24, 26, and/or 28 card slots on the 12 and 14 and/or 16 end cap connectors in dimension and/or length and/or width.

The 10 card-like structures and/or 12 and 14 and/or 16 connectors may comprise graphics, designs, and/or accompanying character figures. Such character figures may correspond to the provided graphics and/or designs. Graphics, designs and/or characters may include any desired graphic, design, or character whether already known or newly created. Many graphics, designs, and/or characters are well known and may include and/or be inspired from, without limitation, anime, Disney animations, Pixar animations, sports teams, brand names and/or combinations thereof.

The 10 card-like structures and/or 12 and 14 and/or 16 connectors are made of materials well known and readily available to the toy-making industry. Materials may range from a wide variety of available materials such as, without limitation, plastics, laminates, molded plastics, pasteboard or layered pasteboard, paperboard, cardstock, cover stock board stock, paper substrate, foil board, Sintra® PVC foam board, acrylonitrile-butadien-styrene-copolymer (ABS), phlalate-free polyvinyl chloride (PVC), Polyethylene terephthalate glycol-modified (PETG), and/or combinations thereof.

The 10 card-like structures and/or 12 and 14 and/or 16 connectors disclosed herein may additionally incorporate Lego® bricks or other similar compatible building bricks for use in conjunction therewith.

The 10 card-like structures and/or 12 and 14 and/or 16 connectors of the present invention may incorporate reasonable design parameters, features, modifications, advantages, and variations that are readily apparent to those skilled in the art in the field of toy building sets.

Without departing from the scope and spirit of the present invention, reasonable features, modifications, advantages, and design variations of the claimed invention will become readily apparent to those skilled in the art by following the guidelines set forth in the preceding detailed description and embodiments.

What is claimed is:

1. A connector toy assembly comprising:

a plurality of card-like structures including at least a first card-like structure, the first card-like structure including a first card edge; and a rectangle-shaped first end cap connector including (i) a top side, (ii) an opposed bottom side, (iii) a plurality of edges that define a perimeter of the first end cap connector, the plurality of edges extending between the top side and the bottom side, (iv) a plurality of first slots that are formed into the top side of the first end cap connector, each of the plurality of first slots being positioned parallel to two of the plurality of edges and parallel to one of the other first slots, each of the plurality of first slots being sized and shaped to selectively receive the first card edge, each of the plurality of first slots is positioned spaced apart from the perimeter of the first end cap connector, and each of the plurality of first slots is positioned spaced apart from one another, (v) a plurality of second slots that are formed into the bottom side of the first end cap connector, each of the plurality of second slots being positioned parallel to two of the plurality of edges and parallel to one of the other second slots, each of the plurality of second slots being sized and shaped to selectively receive the first card edge, each of the plurality of second slots is positioned spaced apart from the perimeter of the first end cap connector, and each of the plurality of second slots is positioned spaced apart from one another, and (vi) a plurality of side slots, with one side slot being formed directly into each of the plurality of edges, each of the plurality of side slots being sized and shaped to selectively receive the first card edge, each of the plurality of side slots being spaced apart from each of the other side slots, and each of the side slots facing radially outward;

wherein the first end cap connector includes at least one protrusion that extends away from one of the edges, and wherein one of the side slots extends through the at least one protrusion.

2. The connector toy assembly of claim 1 wherein the first end cap connector further includes a male connection pattern formed on the top side between the plurality of first slots, and a female connection pattern formed on the bottom side between the plurality of second slots.

3. The connector toy assembly of claim 1 further comprising a rectangle-shaped second end cap connector including (i) a top side, (ii) an opposed bottom side, (iii) a plurality of edges that define a perimeter of the second end cap connector, the plurality of edges extending between the top side and the bottom side, (iv) a plurality of first slots that are formed into the top side of the second end cap connector, each of the plurality of first slots being positioned parallel to two of the plurality of edges and parallel to one of the other first slots, each of the plurality of first slots being sized and shaped to selectively receive the first card edge, (v) a plurality of second slots that are formed into the bottom side of the second end cap connector, each of the plurality of second slots being positioned parallel to two of the plurality of edges and parallel to one of the other second slots, each of the plurality of second slots being sized and shaped to selectively receive the first card edge, and (vi) a plurality of side slots, with one side slot being formed into each of the plurality of edges, each of the plurality of side slots being sized and shaped to selectively receive the first card edge.

4. The connector toy assembly of claim 3 wherein the first card-like structure further includes a second card edge that is opposed to the first card edge, wherein the first card edge is positioned in one of the first slots of the first end cap connector, and wherein the second card edge is positioned in one of the second slots of the second end cap connector.

5. The connector toy assembly of claim 4 further comprising a second card-like structure having a first card edge and an opposed second card edge, wherein the first card edge of the second card-like structure is positioned in another of the first slots of the first end cap connector, and wherein the second card edge of the second card-like structure is positioned in another of the second slots of the second end cap connector.

6. The connector toy assembly of claim 3 wherein the first card-like structure further includes a second card edge that is opposed to the first card edge, wherein the first card edge is positioned in one of the side slots of the first end cap connector, and wherein the second card edge is positioned in one of the side slots of the second end cap connector.

7. The connector toy assembly of claim 3 wherein the first end cap connector further includes a first connection pattern formed on the top side between the plurality of first slots; wherein the second end cap connector further includes a second connection pattern formed on the bottom side between the plurality of second slots; and wherein the first connection pattern is configured to selectively engage the second connection pattern so that the first end cap connector can be selectively directly coupled to the second end cap connector.

8. A connector toy assembly comprising:

a plurality of card-like structures including at least a first card-like structure, the first card-like structure including a first card edge; and a rectangle-shaped first end cap connector including (i) a top side, (ii) an opposed bottom side, (iii) a plurality of edges that define a perimeter of the first end cap connector, the plurality of edges extending between the top side and the bottom side, (iv) a plurality of first slots that are formed into the top side of the first end cap connector, each of the plurality of first slots being positioned parallel to two of the plurality of edges and parallel to one of the other first slots, each of the plurality of first slots being sized and shaped to selectively receive the first card edge, each of the plurality of first slots is positioned spaced apart from the perimeter of the first end cap connector, and each of the plurality of first slots is positioned spaced apart from one another, (v) a plurality of second slots that are formed into the bottom side of the first end cap connector, each of the plurality of second slots being positioned parallel to two of the plurality of edges and parallel to one of the other second slots, each of the plurality of second slots being sized and shaped to selectively receive the first card edge, each of the plurality of second slots is positioned spaced apart from the perimeter of the first end cap connector, and each of the plurality of second slots is positioned spaced apart from one another, and (vi) a plurality of side slots, with one side slot being formed directly into each of the plurality of edges, each of the plurality of side slots being sized and shaped to selectively receive the first card edge, each of the plurality of side slots being spaced apart from each of the other side slots, and each of the side slots facing radially outward; and wherein the first end cap connector includes a receiving space that is formed into one of the edges, and wherein one of the side slots extends through the receiving space.

9. A connector toy assembly comprising:

a plurality of card-like structures including at least a first card-like structure, the first card-like structure including a first card edge;

a rectangle-shaped first end cap connector including (i) a top side, (ii) an opposed bottom side, (iii) a plurality of edges that define a perimeter of the first end cap connector, the plurality of edges extending between the top side and the bottom side, (iv) a plurality of first slots that are formed into the top side of the first end cap connector, each of the plurality of first slots being positioned parallel to two of the plurality of edges and parallel to one of the other first slots, each of the plurality of first slots being sized and shaped to selectively receive the first card edge, each of the plurality of first slots is positioned spaced apart from the perimeter of the first end cap connector, and each of the plurality of first slots is positioned spaced apart from one another, (v) a plurality of second slots that are formed into the bottom side of the first end cap connector, each of the plurality of second slots being positioned parallel to two of the plurality of edges and parallel to one of the other second slots, each of the plurality of second slots being sized and shaped to selectively receive the first card edge, each of the plurality of second slots is positioned spaced apart from the perimeter of the first end cap connector, and each of the plurality of second slots is positioned spaced apart from one another, and (vi) a plurality of side slots, with one side slot being formed directly into each of the plurality of edges, each of the plurality of side slots being sized and shaped to selectively receive the first card edge, each of the plurality of side slots being spaced apart from each of the other side slots, and each of the side slots facing radially outward; and a rectangle-shaped second end cap connector including (i) a top side, (ii) an opposed bottom side, (iii) a plurality of edges that define a perimeter of the second end cap connector, the plurality of edges extending between the top side and the bottom side, (iv) a plurality of first slots that are formed into the top side of the second end cap connector, each of the plurality of first slots being positioned parallel to two of the plurality of edges and parallel to one of the other first slots, each of the plurality of first slots being sized and shaped to selectively receive the first card edge, (v) a plurality of second slots that are formed into the bottom side of the second end cap connector, each of the plurality of second slots being positioned parallel to two of the plurality of edges and parallel to one of the other second slots, each of the plurality of second slots being sized and shaped to selectively receive the first card edge, and (vi) a plurality of side slots, with one side slot being formed into each of the plurality of edges, each of the plurality of side slots being sized and shaped to selectively receive the first card edge;

wherein the first end cap connector further includes a receiving space that is formed into one of the edges of the first end cap connector; wherein the second end cap connector includes a pair of protrusions that extend away from one of the edges of the second end cap connector; and wherein the receiving space is configured to selectively receive the pair of protrusions to selectively couple the first end cap connector to the second end cap connector.

10. A connector toy assembly comprising:

a plurality of card-like structures including at least a first card-like structure, the first card-like structure including a first card edge and an opposed second card edge;

a first end cap connector including (i) a top side, (ii) an opposed bottom side, (iii) a plurality of edges that define a perimeter of the first end cap connector, the plurality of edges extending between the top side and the bottom side, (iv) a plurality of first slots that are formed into the top side of the first end cap connector, each of the first slots being positioned parallel to at least one of the plurality of edges, each of the plurality of first slots being spaced apart from the perimeter of the first end cap connector and spaced apart from each of the other first slots, and each of the plurality of first slots being sized and shaped to selectively receive one of the first card edge and the second card edge, (v) a first connection pattern formed on the top side of the first end cap connector between the plurality of first slots, and (vi) a pair of protrusions that extend away from one of the edges of the first end cap connector; and a second end cap connector including (i) a top side, (ii) an opposed bottom side, (iii) a plurality of edges that define a perimeter of the second end cap connector, the plurality of edges extending between the top side and the bottom side, (iv) a plurality of second slots that are formed into the bottom side of the second end cap connector, each of the second slots being positioned parallel to at least one of the plurality of edges, each of the plurality of second slots being spaced apart from the perimeter of the second end cap connector and spaced apart from each of the other second slots, and each of the plurality of second slots being sized and shaped to selectively receive one of the first card edge and the second card edge, (v) a second connection pattern formed on the bottom side of the second end cap connector between the plurality of second slots, and (vi) a receiving space that is formed into one of the edges of the second end cap connector;

wherein the first connection pattern is configured to selectively engage the second connection pattern so that the first end cap connector can be selectively directly coupled to the second end cap connector; and wherein the receiving space is configured to selectively receive the pair of protrusions to selectively couple the first end cap connector to the second end cap connector.

11. The connector toy assembly of claim 10 wherein the first end cap connector includes four edges that are oriented relative to one another so that the first end cap connector is rectangle-shaped; and wherein the second end cap connector includes four edges that are oriented relative to one another so that the second end cap connector is rectangle-shaped.

12. The connector toy assembly of claim 10 wherein the first end cap connector further includes a plurality of third slots that are formed into the bottom side of the first end cap connector, each of the plurality of third slots being positioned parallel to at least one of the plurality of edges, each of the plurality of third slots being spaced apart from the perimeter of the first end cap connector and spaced apart from each of the other third slots, and each of the plurality of third slots being sized and shaped to selectively receive one of the first card edge and the second card edge.

13. The connector toy assembly of claim 12 wherein the second end cap connector further includes a plurality of fourth slots that are formed into the top side of the second end cap connector, each of the plurality of fourth slots being positioned parallel to at least one of the plurality of edges, each of the plurality of fourth slots being spaced apart from the perimeter of the second end cap connector and spaced apart from each of the other fourth slots, and each of the plurality of fourth slots being sized and shaped to selectively receive one of the first card edge and the second card edge.

14. The connector toy assembly of claim 13 wherein the first end cap connector further includes a plurality of side slots, with one side slot being formed into each of the edges of the first end cap connector, each of the side slots being sized and shaped to selectively receive one of the first card edge and the second card edge; and wherein the second end cap connector further includes a plurality of second side slots, with one second side slot being formed into each of the edges of the second end cap connector, each of the second side slots being sized and shaped to selectively receive one of the first card edge and the second card edge.

15. The connector toy assembly of claim 14 wherein the first card edge of the first card-like structure is positioned in one of the side slots of the first end cap connector, and wherein the second card edge of the first card-like structure is positioned in one of the second side slots of the second end cap connector.

16. The connector toy assembly of claim 14 wherein one of the side slots of the first end cap connector extends through the pair of concentric protrusions; and wherein one of the second side slots of the second end cap connector extends through the receiving rectangular space.

17. The connector toy assembly of claim 10 wherein the first card edge of the first card-like structure is positioned in one of the first slots of the first end cap connector, and wherein the second card edge of the first card-like structure is positioned in one of the second slots of the second end cap connector.

18. The connector toy assembly of claim 17 wherein the plurality of card-like structures further includes a second card-like structure having a first card edge and an opposed second card edge, wherein the first card edge of the second card-like structure is positioned in another of the first slots of the first end cap connector, and wherein the second card edge of the second card-like structure is positioned in another of the second slots of the second end cap connector.

19. The connector toy assembly of claim 10 wherein the first end cap connector further includes a receiving rectangular space that is formed into one of the edges of the first end cap connector; wherein the second end cap connector includes a pair of concentric protrusions that extend away from one of the edges of the second end cap connector; and wherein the receiving rectangular space is configured to selectively receive the pair of concentric protrusions to selectively couple the first end cap connector to the second end cap connector.

20. A connector toy assembly comprising:

a plurality of card-like structures including at least a first card-like structure, the first card-like structure including a first card edge; and a rectangle-shaped first end cap connector including (i) a top side, (ii) an opposed bottom side, (iii) a plurality of edges that define a perimeter of the first end cap connector, the plurality of edges extending between the top side and the bottom side, (iv) a plurality of first slots that are formed into the top side of the first end cap connector, each of the plurality of first slots being positioned parallel to two of the plurality of edges and parallel to one of the other first slots, each of the plurality of first slots being sized and shaped to selectively receive the first card edge, (v) a plurality of second slots that are formed into the bottom side of the first end cap connector, each of the plurality of second slots being positioned parallel to two of the plurality of edges and parallel to one of the other second slots, each of the plurality of second slots being sized and shaped to selectively receive the first card edge, and (vi) a plurality of side slots, with one side slot being formed into each of the plurality of edges, each of the plurality of side slots being sized and shaped to selectively receive the first card edge; wherein the first end cap connector further includes a receiving space that is formed into one of the edges of the first end cap connector; and a rectangle-shaped second end cap connector including (i) a top side, (ii) an opposed bottom side, (iii) a plurality of edges that define a perimeter of the second end cap connector, the plurality of edges extending between the top side and the bottom side, (iv) a plurality of first slots that are formed into the top side of the second end cap connector, each of the plurality of first slots being positioned parallel to two of the plurality of edges and parallel to one of the other first slots, each of the plurality of first slots being sized and shaped to selectively receive the first card edge, (v) a plurality of second slots that are formed into the bottom side of the second end cap connector, each of the plurality of second slots being positioned parallel to two of the plurality of edges and parallel to one of the other second slots, each of the plurality of second slots being sized and shaped to selectively receive the first card edge, and (vi) a plurality of side slots, with one side slot being formed into each of the plurality of edges, each of the plurality of side slots being sized and shaped to selectively receive the first card edge; wherein the second end cap connector includes a pair of protrusions that extend away from one of the edges of the second end cap connector; and wherein the receiving space is configured to selectively receive the pair of protrusions to selectively couple the first end cap connector to the second end cap connector.

21. A connector toy assembly comprising:

a plurality of card-like structures including at least a first card-like structure, the first card-like structure including a first card edge;

a rectangle-shaped first end cap connector including (i) a top side, (ii) an opposed bottom side, (iii) a plurality of edges that define a perimeter of the first end cap connector, the plurality of edges extending between the top side and the bottom side, (iv) a male connection pattern formed on the top side, (v) a female connection pattern formed on the bottom side; and (vi) a receiving space formed into one of the edges; (vii) a plurality of first slots that are formed into the top side of the first end cap connector, each of the plurality of first slots being positioned parallel to two of the plurality of edges and parallel to one of the other first slots, each of the plurality of first slots being sized and shaped to selectively receive the first card edge, (viii) a plurality of second slots that are formed into the bottom side of the first end cap connector, each of the plurality of second slots being positioned parallel to two of the plurality of edges and parallel to one of the other second slots, each of the plurality of second slots being sized and shaped to selectively receive the first card edge, and (ix) a plurality of side slots, with one side slot being formed into each of the plurality of edges, each of the plurality of side slots being sized and shaped to selectively receive the first card edge; and a rectangle-shaped second end cap connector including (i) a top side, (ii) an opposed bottom side, (iii) a plurality of edges that define a perimeter of the second end cap connector, the plurality of edges extending between the top side and the bottom side, (iv) a male connection pattern formed on the top side, and (v) a female connection pattern formed on the bottom side; and (vi) a protrusion that extends away from one of the edges of the second end cap connector; wherein the protrusion is configured to fit into the receiving space in the first end cap connector to selectively couple the first end cap connector to the second end cap connector.

22. The connector toy assembly of claim 21 wherein the second end cap connector includes at least two protrusions that fit into the receiving space, and each protrusion is cylindrical shaped.

* * * * *